United States Patent [19]

Iwamitu et al.

[11] 4,068,484

[45] Jan. 17, 1978

[54] AUTOMATIC TUNNEL FACE HYDRAULIC PRESSURE CONTROLLING APPARATUS IN SHIELD TYPE HYDRAULIC TUNNEL BORING SYSTEM

[75] Inventors: Yasuyuki Iwamitu, Ichikawa; Yoshiaki Uchida, Koshigaya; Shigeru Kobayashi; Masamitu Tateno, both of Tokyo, all of Japan

[73] Assignee: Tekken Construction Co., Ltd., Tokyo, Japan

[21] Appl. No.: 767,037

[22] Filed: Feb. 9, 1977

[30] Foreign Application Priority Data

Apr. 5, 1976 Japan ..... 51-37201

[51] Int. Cl.[2] ..... E21D 9/00

[52] U.S. Cl. ..... 61/85; 415/1

[58] Field of Search ..... 61/42, 84, 85; 415/1; 299/10

[56] References Cited

U.S. PATENT DOCUMENTS

| | | | |
|---|---|---|---|
| 3,334,945 | 8/1967 | Bartlett | 61/85 X |
| 3,769,804 | 11/1973 | Matsushima | 61/85 |
| 3,778,107 | 12/1973 | Haspert | 61/85 X |

FOREIGN PATENT DOCUMENTS

| | | | |
|---|---|---|---|
| 250,968 | 2/1970 | U.S.S.R. | 61/85 |

*Primary Examiner*—Paul R. Gilliam
*Assistant Examiner*—David H. Corbin
*Attorney, Agent, or Firm*—Burns, Doane, Swecker & Mathis

[57] ABSTRACT

An apparatus for automatically controlling tunnel face hydraulic pressure in a hydraulic chamber defined by a rotary cutter head and bulkhead in a shield type excavator used in hydraulic tunnel boring system including a pipe for feeding a hydraulic material with a feeding pump from a reservoir to the chamber and a pipe for discharging a mixture of the fed hydraulic material with ground formations excavated by the cutter head from the chamber to the reservoir with a discharging pump. The apparatus substantially comprises a pressure gauge for measuring actual hydraulic pressure in the chamber, a pressure regulating valve in the feeding pipe as disposed close to the chamber, a first pressure regulator in which a predetermined feeding pressure is preset for comparing the actual pressure measured by the gauge with the predetermined feeding pressure and controllably operating the valve responsive to any difference between the pressures compared in the first regulator, and a second pressure regulator in which a predetermined pumping pressure is preset for comparing the actual pressure with the predetermined pumping pressure and controlling pumping rate of the feeding pump responsive to any difference between the pressures compared in the second regulator. The predetermined pumping pressure preset in the second regulator is preferrably made slightly higher than the predetermined feeding pressure preset in the first regulator.

3 Claims, 1 Drawing Figure

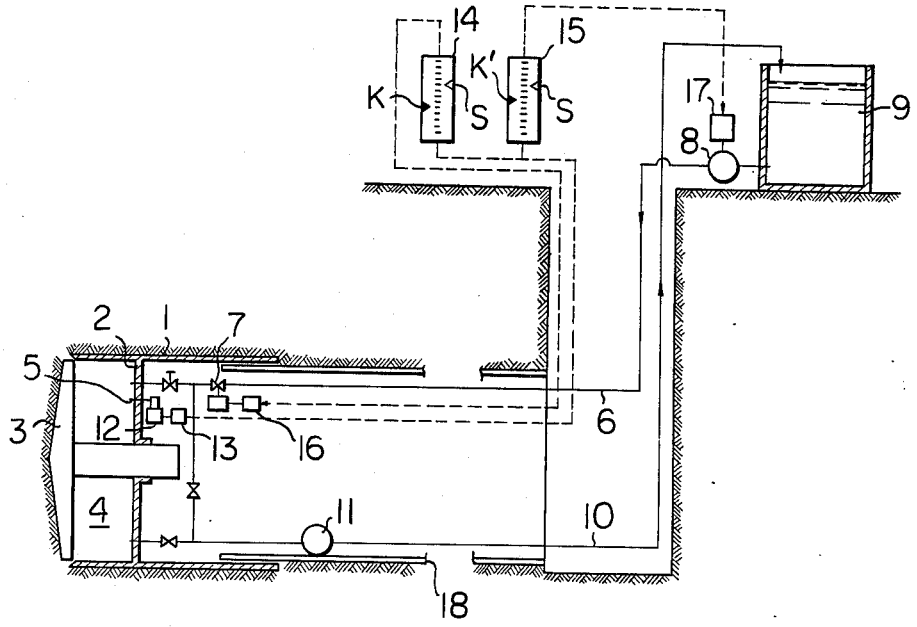
14
15
K
K'
S
S
17
9
8
2
1
7
5
3
12
13
16
6
4
11
10
18

AUTOMATIC TUNNEL FACE HYDRAULIC PRESSURE CONTROLLING APPARATUS IN SHIELD TYPE HYDRAULIC TUNNEL BORING SYSTEM

This invention relates to shield type hydraulic tunnel boring systems and, more particularly, to improvements in apparatuses for automatically controlling hydraulic pressure on tunnel face of ground layer being bored by tunnel boring shield excavator.

Generally, it is very important for performing the hydraulic tunnel boring to properly maintain the hydraulic pressure on the tunnel face since, in the case when the hydraulic pressure becomes unstable, the ground layer which is generally unstable where the hydraulic boring system is employed may easily collapse even entailing serious ground sinking due to so-called piping phenomenon or the like with possible expansion and contraction of the layer around the tunnel face. It is absolutely necessary, therefore, to maintain the tunnel face hydraulic pressure stably constant during the tunnel boring.

In order to maintain the tunnel face hydraulic pressure constant in the boring system of the kind referred to, there has been suggested in, for example, the U.S. Pat. No. 3,769,804 a method wherein a hydraulic pressure setter included in a pressure regulator is set at a predetermined pressure, a pressure indicating signal transmitter is provided in a hydraulic chamber formed at boring head behind a rotary cutter of the tunnel boring shield excavator, any fluctuations in the hydraulic pressure inside the chamber are detected by the transmitter and an electric signal representing an external disturbance to the predetermined pressure is presented to the regulator, whereby a pump associated with a pipe for feeding a hydraulic material to the hydraulic chamber is precisely adjusted in its pumping rate and thus the hydraulic material fed is properly adjusted in its amount required for maintaining the predetermined pressure. According to this method, on the other hand, the feeding pump is installed on the ground surface so as to be at a distance from the tunnel face, which distance being increased as the boring advances, and results of adjustments of the hydraulic material feeding rate or amount at the end of the tunnel face is subject to a certain time lag due to such distance. There has been also suggested as another measure to control the feeding amount of the hydraulic material by means of a valve provided in the feeding pipe, but it is difficult to expect a quick rise of the hydraulic pressure at the tunnel face due to restricted amount of the material fed by the pump so that the tunnel face hydraulic pressure cannot be controlled promptly when the same is decreased.

The present invention has been suggested to remove such defects as described above, successfully regulating the tunnel face hydraulic pressure involving less time lag with a provision of a regulating valve in the hydraulic material feeding pipe at a position close to the hydraulic chamber of the excavator and controlling the regulating valve and the hydraulic material feeding pump.

A primary object of the present invention is, therefore, to provide an automatic controlling apparatus for the tunnel face hydraulic pressure in the shield type hydraulic tunnel boring system, which is capable of achieving the control quickly.

Another object of the present invention is to provide an automatic controlling apparatus of the kind referred to which is capable of finely regulating the tunnel face hydraulic pressure.

A further object of the present invention is to provide an automatic controlling apparatus of the kind referred to which is capable of controlling the tunnel face hydraulic pressure over a large range.

Yet another object of the present invention is to provide an automatic controlling apparatus of the kind referred to which achieves a smooth control of the tunnel face hydraulic pressure.

Other objects and advantages of the present invention will be made clear as the following explanations of the invention advance as detailed with reference to a preferred embodiment of the invention shown in accompanying drawing, in which:

The drawing is a schematic sectioned view showing an entire shield type hydraulic tunnel boring system employing an embodiment of the automatic hydraulic pressure controlling apparatus according to the present invention.

In the drawing, a pressure gauge 5 for measuring the hydraulic pressure in a hydraulic pressure chamber 4 formed between a bulkhead 2 of a shield excavator 1 and a cutter head 3 rotated by a motor or the like (not shown) is provided at the bulkhead 2, a regulating valve 7 is provided at a position close to the bulkhead 2 in a pipe 6 for feeding a hydraulic material being referred to as "water" hereinafter for simplicity) to the chamber 4 from a tank 9 installed on the ground surface through a pump 8. Further, a pipe 10 for discharging excavated ground formations together with the water is connected at one end to the chamber 4 through the bulkhead 2 and at the other end to upper open end of the tank 9 through a pump 11.

Hydraulic pressure measured by the pressure gauge 5 is converted to an electric signal by a pressure transmitter 13, which signal is given to a first regulator 14 which serves for indicating the hydraulic pressure and controlling the valve 7 and to a second regulator 15 which serves for indicating the pressure and controlling a variable speed motor 17 for operating the pump 8.

In the first regulator 14, a predetermined feeding hydraulic pressure value K required for maintaining a proper hydraulic pressure in the chamber 4 is set in advance, an actual pressure value S in the chamber 4 and measured by the gauge 5 is indicated and an electric signal representing a difference if any between the respective pressure values K and S is generated, which signal is given to a converter 16 which controls the regulating valve 7. It is preferable that the converter 16 is of a type which operates the regulating valve 7 by means of, for example, a compressed air responsive to the electric signal from the regulator 14. Also in the second regulator 15, a predetermined pumping hydraulic pressure value K' which is preferably slightly higher than the value K as will be described later is set in advance, the measured actual pressure value S is indicated and an electric signal representing any difference between the respective pressure values K' and S is generated, which signal is given to the variable speed motor 17 to vary the number of revolutions of the pump 8 and the amount and pressure of fed water of the pump.

The operation and effects of the present invention shall be explained in the following. Until the number of pumping revolutions of the pump 8 varies as indicated by the regulator 15 and until an increased hydraulic pressure due to the varied pumping of the pump 8 reaches the water pressure chamber 4, a considerable time is usually required so that there will be caused a certain time lag exist between an initiation of the pressure regulation and an establishment of the required pressure in the chamber 4. In the present invention, the regulating valve 7 of the water feeding pipe 6 is provided at a position close to the bulkhead 2 of the chamber 4 and the lower limit of opening degree of regulating valve 7 is made to be about 20% open so as to render a precise adjustment of the valve opening possible. On the other hand, even if the tunnel face hydraulic pressure is adjusted only by opening or closing the regulating valve 7, it will be impossible to control the tunnel face hydraulic pressure sufficiently unless the pumping water amount is varied to be of a predetermined value. In this case, the tunnel face hydraulic pressure can be adjusted to the predetermined value by varying the number of revolutions of the pump. That is, the required control of the tunnel face hydraulic pressure can be achieved in two steps of controlling the regulating valve 7 and the number of revolutions of the variable speed pump 8. In case the variation of the tunnel face pressure is slight, the control will be achieved only by opeing or closing the regulating valve 7.

Further, the predetermining pumping pressure value K' of the regulator 15 is preferably made to be slightly higher than the predetermined feeding pressure value S of the regulator 14, so that the tunnel face hydraulic pressure will be controlled more favorably. In the single control of the regulating valve 7 or of the variable speed pump 8, the controlled range of the tunnel face hydraulic pressure is about 0.2 to 0.3 kg./cm$^2$. However, if the two regulators are used according to the present invention to vary their set pressures, the controlled range of the tunnel face hydraulic pressure will be able to be expanded to 0.2 to 0.5 kg./cm$^2$.

What is claimed is:

1. In a hydraulic tunnel boring system using a shield type boring excavator including a hydraulic pressure chamber defined between a rotary cutter head and a bulkhead, said chamber is filled with a hydraulic material fed through a feeding pipe from a hydraulic material reservoir and a mixture of said material and ground formations excavated by rotation of said cutter head is discharged through a discharging pipe to the reservoir, an apparatus for automatically conrolling tunnel face hydraulic pressure in said chamber, which comprises a regulating valve provided in said feeding pipe at a position close to said bulkhead, a feeding pump provided in the feeding pipe, a pressure gauge provided in the hydraulic pressure chamber for measuring actual tunnel face hydraulic pressure in the chamber, a pressure signal transmitter connected to said gauge for converting pressure value measured and provided by the gauge into an electric signal, a first regulator receiving said signal from said transmitter and controlling said regulating valve in response to differences between the signal indicating said actual tunnel face hydraulic pressure and a predetermined pressure preliminarily set in said first regulator, and a second regulator receiving the signal from the transmitter and controlling pumping rate of said feeding pump in response to differences between the signal indicating the actual tunnel face hydraulic pressure and a predetermined pressure preliminarily set in said second regulator.

2. An apparatus according to claim 1 wherein said predetermined pressure set in said second regulator is higher than said predetermined pressure set in said first regulator.

3. An apparatus according to claim 1 wherein said regulating valve is controlled by means of a compressed air responsive to a signal provided by said first regulator.

* * * * *